US011607104B1

(12) United States Patent
Dunaway

(10) Patent No.: US 11,607,104 B1
(45) Date of Patent: Mar. 21, 2023

(54) QUICK-WASH FEATURE FOR DISHWASHER APPLIANCE

(71) Applicant: Haier US Appliance Solutions, Inc., Wilmington, DE (US)

(72) Inventor: Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 12 days.

(21) Appl. No.: 17/473,179

(22) Filed: Sep. 13, 2021

(51) Int. Cl.

| | |
|---|---|
| ***A47L 15/16*** | (2006.01) |
| ***A47L 15/22*** | (2006.01) |
| ***A47L 15/42*** | (2006.01) |
| ***A47L 15/44*** | (2006.01) |
| ***A47L 15/50*** | (2006.01) |

(52) U.S. Cl.
CPC ..... *A47L 15/4257* (2013.01); *A47L 15/16* (2013.01); *A47L 15/22* (2013.01); *A47L 15/4217* (2013.01); *A47L 15/4246* (2013.01); *A47L 15/4293* (2013.01); *A47L 15/4418* (2013.01); *A47L 15/50* (2013.01); *A47L 2301/04* (2013.01)

(58) Field of Classification Search
None
See application file for complete search history.

(56) References Cited

U.S. PATENT DOCUMENTS

| | | | |
|---|---|---|---|
| 3,421,525 | A | 1/1969 | Gustav |
| 4,106,517 | A | 8/1978 | Wright |
| 8,349,089 | B2 | 1/2013 | Bertsch |

FOREIGN PATENT DOCUMENTS

| | | | |
|---|---|---|---|
| DE | 19960496 | A1 | 7/2001 |
| FR | 2387016 | A1 | 11/1978 |

*Primary Examiner* — Levon J Shahinian
(74) *Attorney, Agent, or Firm* — Dority & Manning, P.A.

(57) ABSTRACT

A dishwasher appliance including a quick-wash feature. A secondary door attached is attached to a main door and forms a quick-wash compartment. A quick-wash assembly provides fluid for cleaning. Articles may be supported on the secondary door during cleaning or may be manually supported by the user at the quick-wash assembly. Various modes of operation may be used for cleaning including wash and rinse functions.

18 Claims, 7 Drawing Sheets

QUICK-WASH FEATURE FOR DISHWASHER APPLIANCE

FIELD OF THE INVENTION

The present disclosure relates generally to dishwasher appliances, and more particularly to a dishwasher appliance with a quick-wash function.

BACKGROUND OF THE INVENTION

Dishwasher appliances generally include several wash cycles for different levels of soiled articles and different types of articles. Dishwashers may further have different rack assemblies for positioning various articles for cleaning within a wash chamber. One or more devices such as nozzles or spray assemblies may be included at various locations relative to the rack assemblies for purposes of delivering fluids as part of the cleaning process.

Cleaning cycles may vary and can include options for heavily soiled cleaning, regular cleaning, and lighter cleaning that may be selected by the user. Cycle times may vary from minutes to several hours depending on the cycle selected. Dishwasher appliances may be configured to operate on the assumption that all of the rack assemblies are loaded with articles while some may have the option to clean just the articles on one rack assembly by e.g., delivering fluids to only one or some of the nozzles or spray assemblies in the dishwasher appliance.

Rack assemblies are generally configured to support many articles for cleaning. Even a single rack assembly may have space to support dozens of articles. However, sometimes a user may need to wash only a single article or only a few articles. In addition, or alternatively, such articles may not be heavily soiled. For example, certain articles such as a plate after eating a sandwich, a cup used for water or coffee, or a bowl that held a snack such as crackers or chips, may not necessarily require the level of cleaning provided by the various cycles of a conventional dishwasher appliance.

Lightly soiled articles may also take up space in a dishwasher appliance that is needed for cleaning more heavily soiled articles—especially when there are many articles to clean. For example, a lunch plate with sandwich crumbs may take up space needed for a more heavily soiled casserole pan. A glass used only for water might not need the same level of cleaning as e.g., a bowl used for mixing cooking ingredients. Further, where only a few lightly soiled articles are to be cleaned, washing the same in a conventional dishwashing appliance may not be energy efficient.

Handwashing may be more efficient for a few articles or lightly soiled articles. However, a user has to perform a series of tasks to handwash including e.g., finding a sponge or rag, locating soap, and then washing and rinsing the article by hand usually in a sink that could be used for something else. Following handwashing, more tasks may follow, including rinsing and wringing out the rag or sponge and rinsing the sink in which handwashing took place. As such, handwashing may be particularly inconvenient to certain users due to the steps required.

Accordingly, a dishwasher appliance having conventional cycles and capacities but also having the additional ability to wash only a few or lightly soiled articles would be useful. For example, a dishwasher appliance having a wash function that allows an article or a few articles to be cleaned with minimal effort or time would be beneficial. A dishwasher that allows a user to control how long to wash or rinse an article would also be desirable. Such a dishwasher that allows the user to avoid handwashing articles would also be beneficial.

BRIEF DESCRIPTION OF THE INVENTION

Additional aspects and advantages of the invention will be set forth in part in the following description, or may be apparent from the description, or may be learned through practice of the invention.

In one exemplary embodiment, a dishwasher appliance is provided. The dishwasher appliance includes a tub, a main door, at least one rack assembly, and at least one spray assembly. The tub defines a wash chamber, and the wash chamber has an opening. The main door is positioned at the opening to the wash chamber and is selectively moveable between a closed position that covers the opening and an open position that allows access to the wash chamber through the opening. The at least one rack assembly is slidably positioned within the wash chamber and configured for the receipt of articles for washing. The at least one spray assembly is positioned in the wash chamber near the at least one rack assembly and configured to direct wash fluids at the at least one rack assembly. The dishwasher appliance may include a quick-wash feature. The quick-wash feature may include a secondary door that is attached to the main door and a quick-wash spray assembly. The secondary door may be moveable between an open position and a closed position. The main door and the secondary door may form a quick-wash compartment when the secondary door is in the closed position. The quick-wash spray assembly may provide fluid for cleaning. The quick-wash spray assembly may be located in the quick-wash compartment when the secondary door is in the closed position.

In another exemplary embodiment, a dishwasher appliance is provided. The dishwasher appliance includes a tub, a main door, at least one rack assembly, and at least one spray assembly. The tub defines a wash chamber, and the wash chamber has an opening. The main door is positioned at the opening to the wash chamber and is selectively moveable between a closed position that covers the opening and an open position that allows access to the wash chamber through the opening. The main door has an interior side facing the wash chamber when the main door is in the closed position. The at least one rack assembly is slidably positioned within the wash chamber and configured for the receipt of articles for washing. The at least one spray assembly is positioned in the wash chamber near the at least one rack assembly and configured to direct wash fluids at the at least one rack assembly. The dishwasher appliance may include a quick-wash feature. The quick-wash feature may be positioned on the interior side of the main door. The quick-wash feature may include a secondary door that is attached to the main door and a quick-wash spray assembly. The secondary door may be moveable between an open position and a closed position. A section of the interior side of the main door and the secondary door may form a quick-wash compartment when the secondary door is in the closed position. The quick-wash spray assembly may provide fluid for cleaning. The quick-wash spray assembly may be located in the quick-wash compartment when the secondary door is in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same of similar reference numerals in the figures denotes the same or similar features unless the context indicates otherwise.

DETAILED DESCRIPTION OF THE INVENTION

Figure 1:
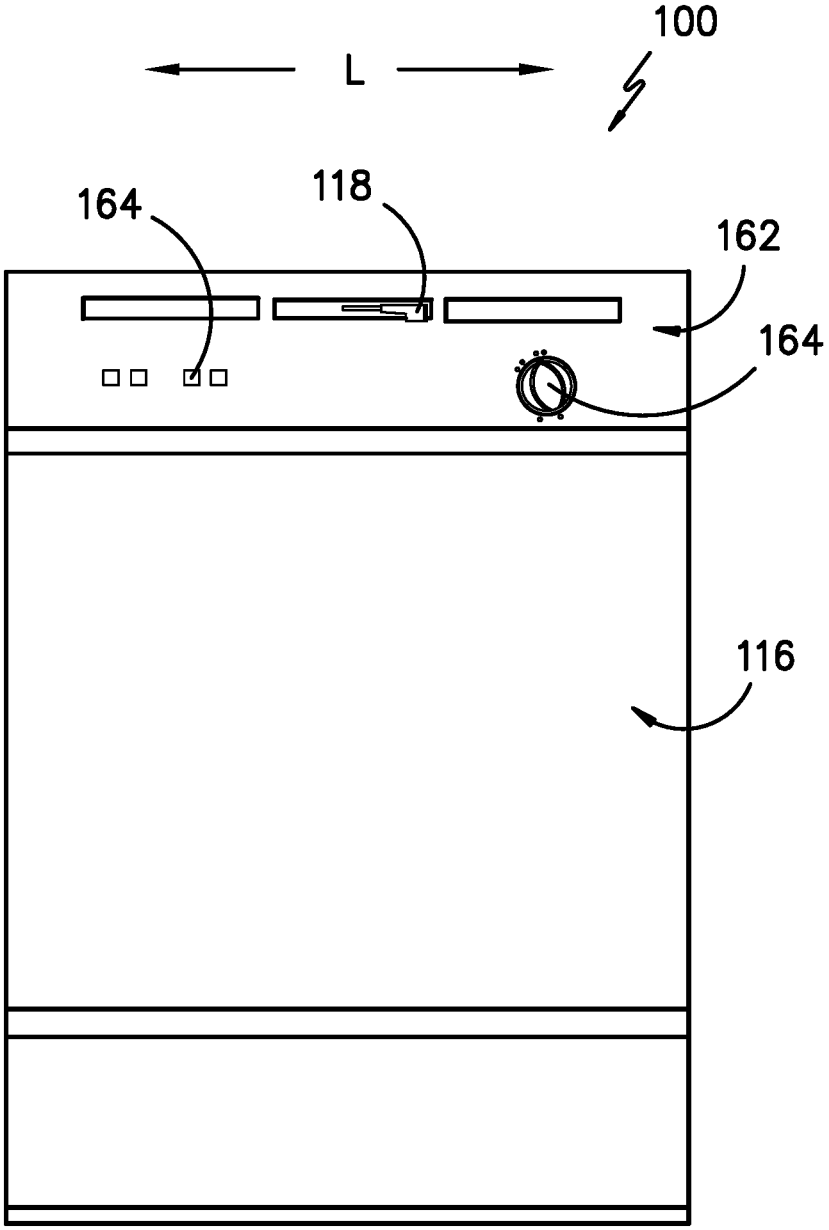
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles. Such may be after completion of the wash cycle, or may be a cycle unto itself. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, and/or a drain cycle. The term "wash fluid" refers to a liquid used for washing and/or rinsing the articles and is typically made up of water that may include other additives such as detergent or other treatments. The term "rinse fluid" refers to a fluid used for rinsing the articles and is typically made up of water and may include other additives such as rinse aid solutions. The term "quick-wash" is intended to refer to the various features described in exemplary embodiments of the invention and does not limit the invention to any particular time period for using such features. The term "wash" is intended to refer or reference the fluid or process of adding detergent to water to remove dirt and particles from articles to be washed. The term "rinse" is intended to refer or reference the fluid or process of using water and potentially rinse aid additives to remove residual soil, detergents, or other undesirable elements that were retained by the articles.

Figure 2:
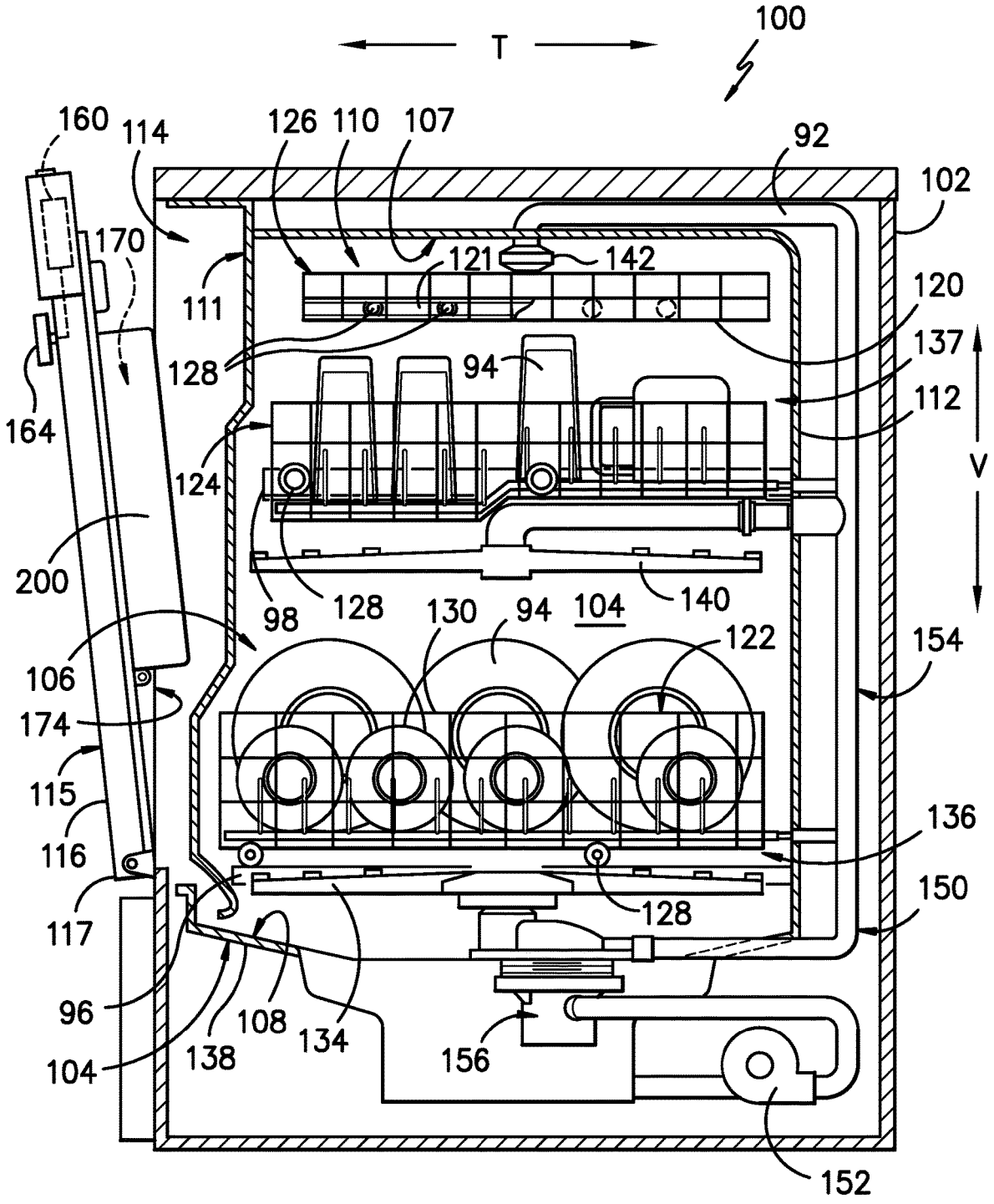
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher appliance 100 includes a cabinet 102 (FIG. 2) having a tub 104 therein that defines a wash chamber 106 for receipt of articles 94 for washing. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L, and transverse direction T are mutually perpendicular to one another.

In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

The tub 104 includes a front opening 114 and a main door 116 hinged at its bottom 117 for movement between a normally closed vertical position (shown in FIG. 1), whereby the wash chamber 106 is sealed shut for washing operation, and a horizontal open position for loading and unloading of articles from the dishwasher appliance 100. Main door 116 is positioned at the opening of wash chamber 106. According to exemplary embodiments, dishwasher appliance 100 further includes a door closure mechanism or assembly 118 that is used to lock and unlock main door 116 for accessing and sealing wash chamber 106.

At least one rack assembly is slidably positioned within wash chamber 106 and is configured for the receipt of articles for cleaning. For the exemplary embodiment shown in FIG. 2, opposing tub side walls 110 accommodate a plurality of rack assemblies. More specifically, guide rails 96, 98 and 120 may be mounted to (or formed as part of) side walls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, upper rack assembly 126 is positioned at a top portion of wash chamber 106 above middle rack assembly 124, which is positioned above lower rack assembly 122 along the vertical direction V. Additional details regarding the upper rack assembly 126 will be provided herein. For this exemplary embodiment, upper rack assembly 126 is supported on middle rack assembly 124 by rails 120 attached to assembly 124 but rails 120 could be supported on opposing side walls 110 as well.

Each rack assembly 122, 124, 126 is adapted for movement along transverse direction T between an extended loading position (not shown) in which the rack is substantially positioned outside the wash chamber 106, and a retracted position (shown in FIGS. 1 and 2) in which the rack is located inside the wash chamber 106. This may be facilitated, for example, by rollers 128 mounted onto rack assemblies 122, 124, 126, respectively. Although guide rails 96, 98, 120 and rollers 128 are illustrated herein as facilitating movement of the respective rack assemblies 122, 124, 126, it should be appreciated that any suitable sliding mechanism or member may be used according to alternative embodiments. In some embodiments, dishwasher appliance 100 may accommodate a different number of rack assemblies and supporting guide rails. For example, dishwasher appliance 100 may accommodate only first rack assembly 122 and upper rack assembly 126, with accompanying guide rails.

Some or all of the rack assemblies 122, 124, 126 may be fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles 94 within wash chamber 106 while allowing a flow of wash fluid to reach and impinge on those articles, e.g., during a cleaning or rinsing cycle. For some embodiments, a silverware basket (not shown) is removably attached to a rack assembly, e.g., lower rack assembly 122, for placement of silverware, utensils, and the like, that are otherwise too small or delicate to be accommodated by rack assembly 122.

At least one spray assembly is located in wash chamber 106 and is configured to direct wash fluids onto at least one rack assembly for washing articles located therein. For the exemplary embodiment of FIG. 2, dishwasher appliance 100 further includes a plurality of spray assemblies for urging a flow of water or wash fluid onto the articles placed within wash chamber 106. More specifically, as illustrated in FIG. 2, dishwasher appliance 100 includes a first spray assembly 134 (also referred to as a lower spray assembly 134) disposed in a lower region 136 of wash chamber 106 and above a sump 138 so as to rotate in relatively close proximity to lower rack assembly 122. Similarly, a second spray assembly 140 (also referred to as a mid-level spray assembly 140) is located in an upper region 137 of wash chamber 106 and may be located below and in close proximity to middle rack assembly 124. In this regard, mid-level spray assembly 140 may generally be configured for urging a flow of wash fluid up through middle rack assembly 124 and third rack assembly 126. Additionally, an upper or third spray assembly 142 (also referred to as an upper spray assembly 142) may be located above upper or third rack assembly 126 along the vertical direction V. In this manner, third spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear side 112 of tub 104 along the vertical direction V to supply wash fluid throughout wash chamber 106. In some examples, a secondary supply conduit (not shown) may supply additional wash fluid to one or more various spray assemblies and manifolds.

As illustrated, primary supply conduit 154 is used to supply wash fluid to mid-level spray assembly 140 while a secondary supply conduit 92 supplies wash fluid to upper spray assembly 142. Diverter assembly 156 can allow selection between spray assemblies 134 and 140, 142 being supplied with wash fluid. However, it should be appreciated that according to alternative embodiments, any other suitable plumbing configuration may be used to supply wash fluid throughout the various spray manifolds and assemblies described herein. Fluid circulation assembly 150 will be described in more detail below.

Each spray assembly 134, 140, 142 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary. Movement of the spray assemblies 134 and 140 and the spray from fixed manifolds like spray assembly 142 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber (not shown) for selectively distributing the wash fluid to the spray assemblies 134, 140, 142 and/or other spray manifolds or devices.

For example, the diverter disk may have a plurality of apertures that are configured to align with one or more outlet ports (not shown) at the top of diverter chamber (not shown). In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which (e.g., 154) are illustrated in FIG. 2 for clarity. More specifically, diverter assembly 156 may include four outlet ports (not shown) for supplying wash fluid to a first conduit for rotating lower spray assembly 134 in the clockwise direction, a second conduit for rotating lower spray assembly 134 in the counterclockwise direction, a third conduit for spraying rack assembly 126 (shown in FIG. 2) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 may be located within a control panel area 162 of main door 116. In such an embodiment, input/output ("I/O") signals may be routed between the control system and various operational components of dishwasher appliance 100 along wiring harnesses that may be routed through the bottom of main door 116. Typically, the controller 160 includes a user interface panel/controls 164 (FIG. 1) through which a user may select various operational features and modes and monitor progress of the dishwasher appliance 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

Dishwasher appliance 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher appliance 100 may be equipped with such image recognition and processing capabilities as part of controller 160 and/or other components onboard appliance 100.

It should be appreciated that the invention is not limited to any particular style, model, or configuration of dishwasher appliance 100. The exemplary embodiment depicted in FIGS. 1 and 2 is for illustrative purposes only. For example, different locations may be provided for user interface 164, different configurations, including providing one or more rack assemblies 122, 124, 126 and one or more spray assemblies 134, 140, 142, to dishwasher appliance 100 may be used, different configurations may be provided for rack assemblies 122, 124, 126, different spray assemblies 134, 140, 142 and spray manifold configurations may be used, and other differences may be applied while remaining within the scope of the present subject matter.

In certain exemplary aspects, the present invention provides a quick-wash feature that allows an article or a few articles to be cleaned with reduced effort and/or time as compared to conventional cycles of a dishwashing appliance. In some embodiments, the quick-wash feature may also allow a user to control how long an article is washed or rinsed. The article may be cleaned while the user holds the article or may be supported by elements of the quick-wash features. Embodiments disclosed herein allow the user to have additional options for cleaning dishes in a dishwasher appliance. Additional exemplary aspects of the present invention are set forth, or will be apparent from, the description that follows of an exemplary embodiment of a quick-wash feature 132.

Figure 3:
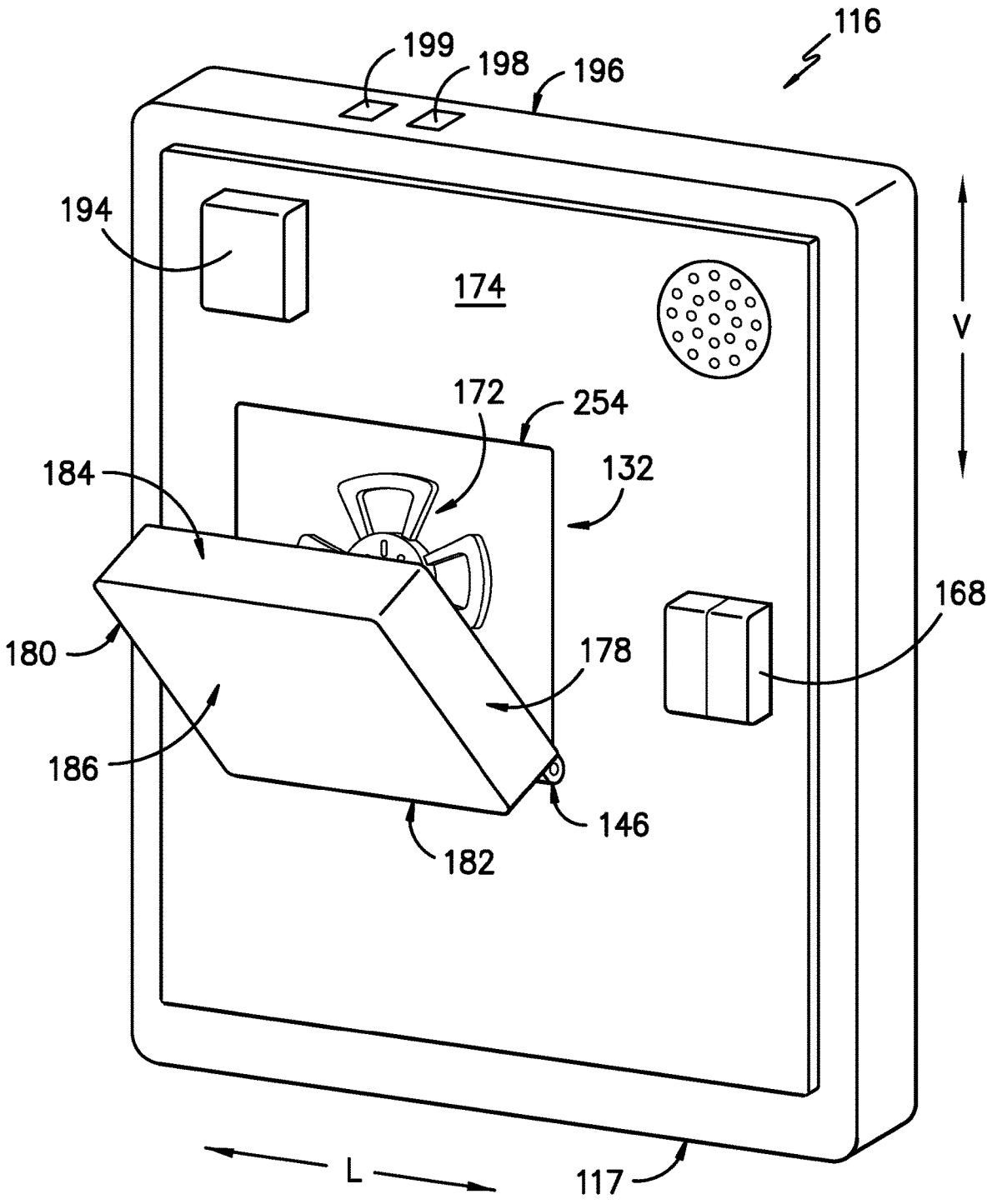
FIG. 3 provides a perspective view of an exemplary door of the exemplary dishwashing appliance of FIG. 1.
Figure 4:
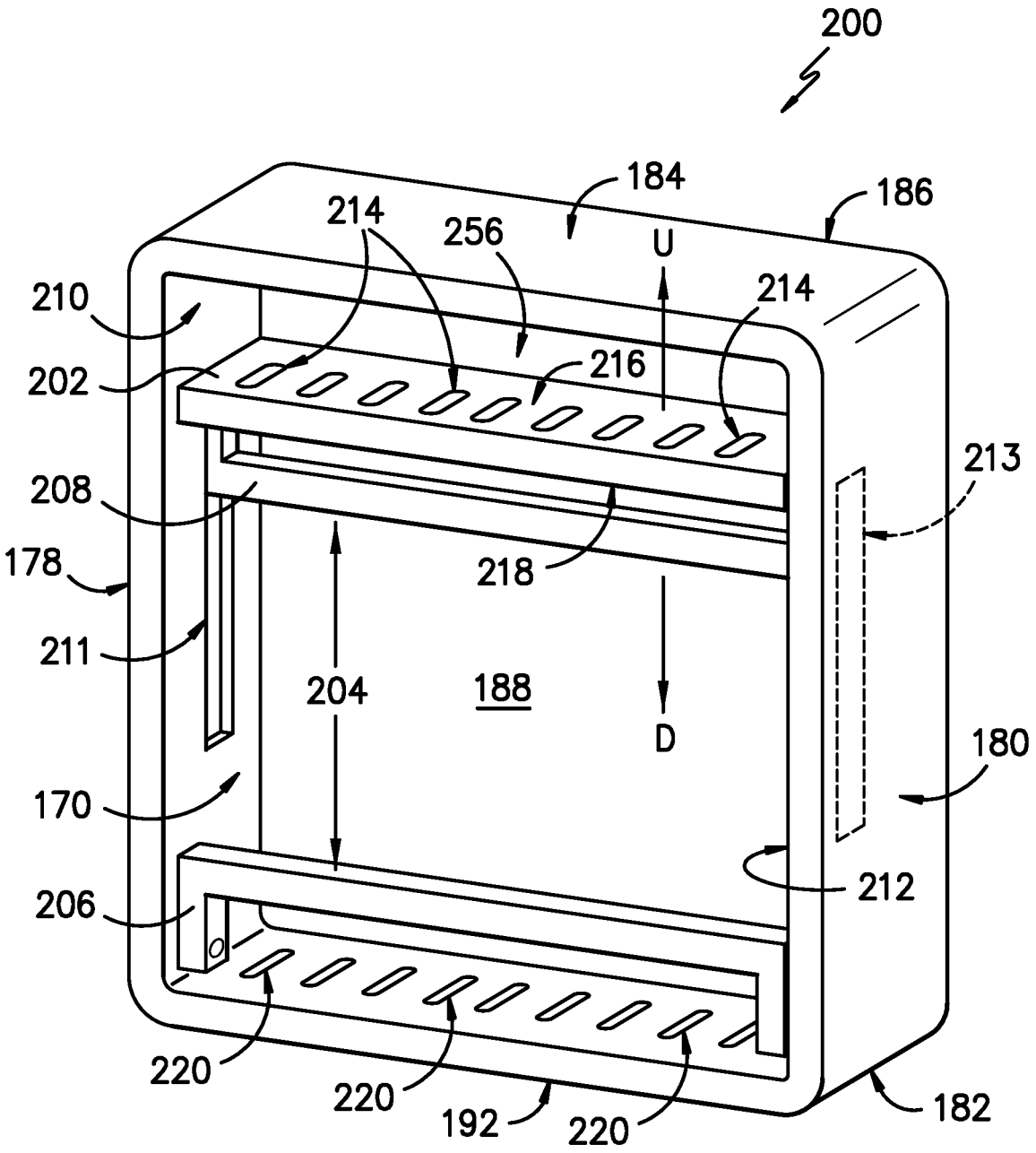
FIG. 4 provides a perspective view of an exemplary door for a quick-wash compartment of the exemplary dishwashing appliance of FIG. 1.
Figure 5:
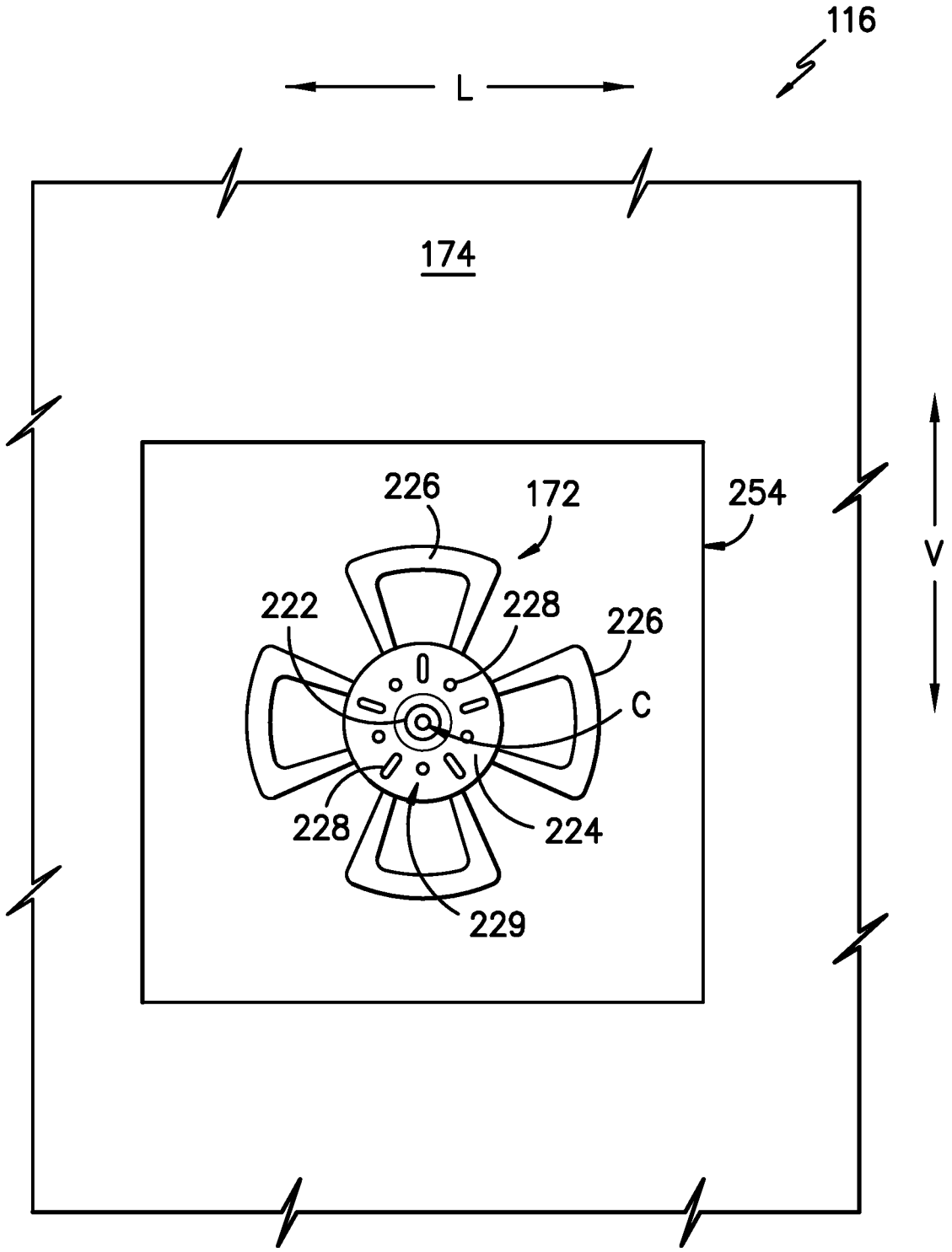
FIG. 5 provides a front view of an exemplary wash compartment on the exemplary door of FIG. 3.
Figure 6:
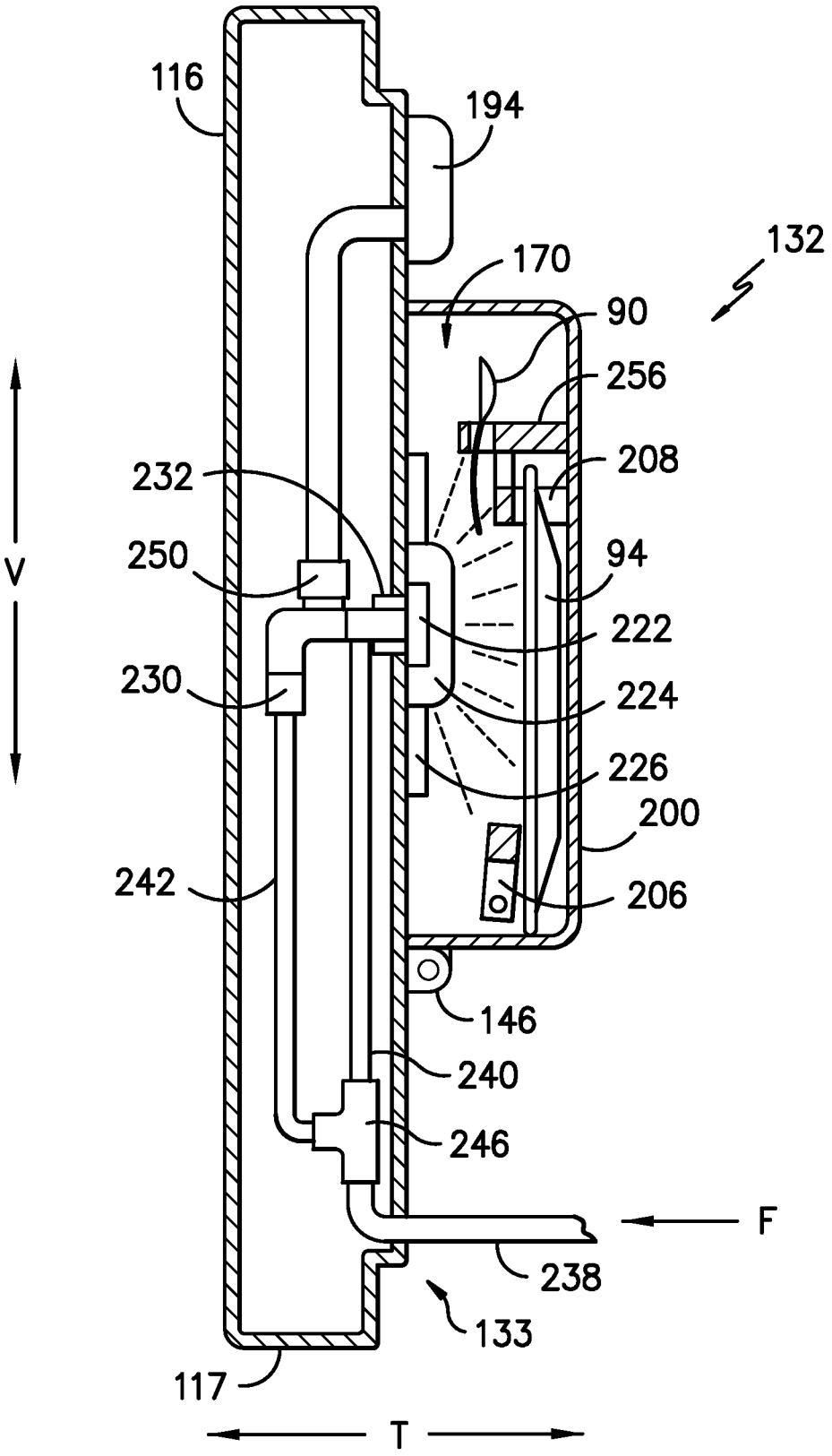
FIG. 6 provides a side, cross sectional view of the exemplary door of FIG. 3, with an exemplary second door in a closed position.

With reference to FIGS. 2 through 7, dishwasher appliance 100 includes a quick-wash feature 132 positioned on the main door 116. The quick-wash feature 132 includes a secondary door 200 that is attached to main door 116. For this exemplary embodiment, quick-wash feature 132 is positioned on an interior side 174 of main door 116. As shown in FIG. 3, interior side 174 of main door 116 faces wash chamber 106 when main door 116 is in the closed position. Main door 116 and secondary door 200 enclose a quick-wash compartment 170 when secondary door 200 is in a closed position as shown in FIGS. 2 and 6.

Secondary door 200 is moveable between an open position (FIGS. 3 and 7) and the closed position (FIGS. 2 and 6). More particularly, in this embodiment, secondary door 200 is pivotably connected to main door 116. A user can open and close secondary door 200 for the purposes including loading and unloading articles in and out of quick-wash compartment 170 and/or accessing quick-wash spray assembly 172. For this embodiment, secondary door 200 has a set of opposing lateral sides 178, 180, bottom and top sides 182 and 184, and a back side 186. Secondary door 200 has an interior surface 188 that faces interior side 174 of main door 116 when secondary door 200 is in the closed position.

A hinge 146 may connect secondary door 200 to interior side 174 at a hinge edge 192 located at bottom side 182. Hinge 146 may include a variety of constructions including bar and loop, spring-loaded, and other constructions as well. In other embodiments, secondary door 200 may be pivotably connected to main door 116 along other sides as well.

Secondary door 200 includes one or more drain holes 220 along bottom side 182 that allow fluid to drain out of the quick-wash compartment 170. Wash fluid may then flow down interior side 174 and flow into sump 138. Other constructions may be used to remove fluid from quick-wash compartment 170 as well.

Though quick-wash feature 132, secondary door 200, and hinge 146 are positioned on interior side 174 of main door 116 in FIGS. 2 through 7, quick-wash feature 132, secondary door 200, and hinge 146 may be placed on another surface of dishwasher appliance 100, such as, but not limited to, exterior side 115 of main door 116.

Figure 7:
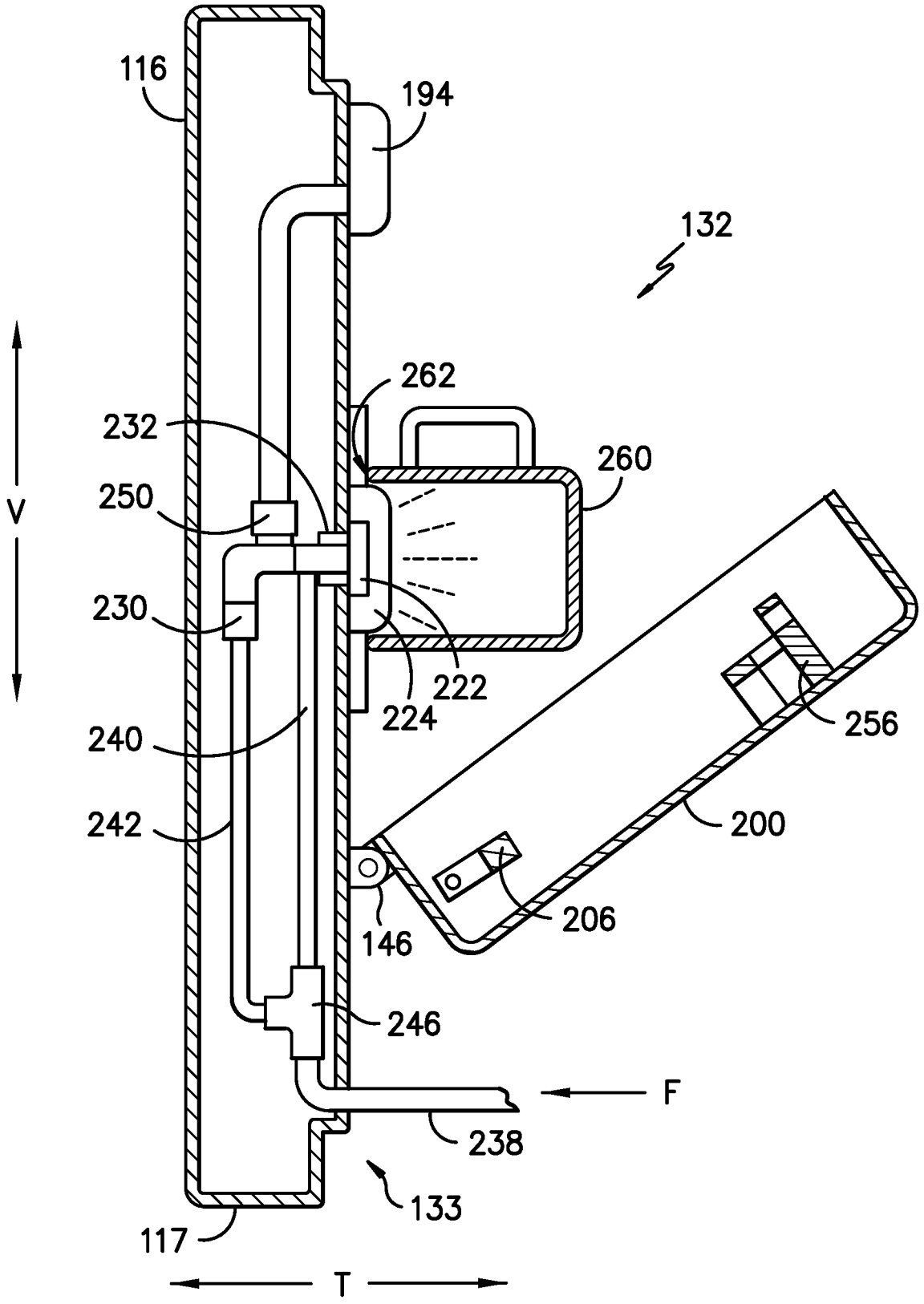
FIG. 7 provides a side, cross sectional view of the exemplary door of FIG. 3, with the exemplary second door in an open position.

For this exemplary embodiment, interior side 174 of main door 116 includes a quick-wash detergent reservoir 194 that is separate from main detergent reservoir 168, which is also formed within main door 116 (FIGS. 3 and 7). Detergent reservoir 168 and quick-wash detergent reservoir 194 are configured for receipt of washing detergent. Quick-wash detergent reservoir 194 is in fluid communication with quick-wash spray assembly 172 and, in this embodiment, is configured for use of liquid detergents. Liquid detergent from quick-wash detergent reservoir 194 (or detergent reservoir 168 if one detergent reservoir is used) can readily mix with fluid provided to quick-wash feature 132 through operation of a detergent control valve 250 as will be further described herein.

As shown in FIG. 4, quick-wash feature 132 includes an adjustable article support assembly 204 that secure articles for washing. In this exemplary embodiment, article support assembly 204 includes a slidable article clamp 256 selectively movable (arrows U and D) along the interior surface 188 and extending between opposing lateral sides 178 and 180. For this embodiment, article clamp 256 is slidable within grooves 211 and 213 defined by lateral inner surfaces 210, 212 of secondary door 200. Springs may be used to bias article clamp 256 in the direction of arrow D to help secure articles.

Article clamp 256 includes a silverware holder 202 for this embodiment. Silverware holder 202 is configured as a plate or bar that defines a plurality of apertures 214 positioned adjacent to each other along lateral direction L and each configured to accept an article 90 (FIG. 6) of silverware (e.g., knives, forks, or spoons) for washing or rinsing. Silverware holder 202 has an upper surface 216 and a lower surface 218. Silverware holder 202 can accept articles 90 inserted e.g., through an aperture 214 and resting on upper surface 216. In some embodiments, the apertures 214 may be of different sizes to accept articles of varying sizes (e.g., serving utensils and silverware). In some embodiments, the apertures 214 may be similarly sized.

For this exemplary embodiment, article clamp 256 includes an upper article jaw 208 that extends vertically downward from silverware holder 202, spans laterally between opposing sides 178 and 180, and is attached to lower silverware surface 218. A lower article jaw 206 extends from bottom side 182 of secondary door 200 and may be attached to opposing lateral inner surfaces 210, 212. Accordingly, an article 94 (e.g., plate or other dish) can be secured between upper article jaw 208 and lower article jaw 206.

Because article clamp 256 is slidable along at least vertical direction V, different positions can be used for different sizes of articles 94. In some embodiments, upper and lower article jaws 206 and 208 may be configured for receipt of more than one article 94 for washing or rinsing. Other constructions of article support assembly 204 may also be used for securing one or more articles in quick-wash compartment 170 as well. For example, such constructions may include features located on main door 116.

Referring to FIGS. 5, 6, and 7, quick-wash feature 132 further includes a quick-wash spray assembly 172. Quick-wash spray assembly 172 is located in quick-wash compartment 170 formed with secondary door 200 when secondary door 200 is in the closed position. The interior side 174 of main door 116 may include a recessed portion 254 forming part of quick-wash compartment 170 and receiving all or part of quick-wash spray assembly 172

Quick-wash spray assembly 172 provides fluid for cleaning articles using quick-wash feature 132. In this exemplary embodiment, quick-wash spray assembly 172 includes a central spray nozzle 222 positioned within a rotating spray disc or arm 224 as shown in FIG. 5. Other features for providing fluids may be used as well.

Central spray nozzle 222 is located within quick-wash spray assembly 172 as shown. Central spray nozzle 222 provides one or more jets or sprays of fluid for cleaning articles and is activated by depressing one or more of a plurality of wash paddles 226 towards interior side 174. For example, with specific reference to FIG. 7, a user may place an article 260 such as a cup or bowl over central spray nozzle 222 and depress wash paddles 226 causing fluid to be sprayed on article 260. The fluid may be provided for a wash (including detergent) or just a rinse.

For this embodiment, wash paddles 226 are positioned equidistant from each other around rotating spray arm 224 and central spray nozzle 222. Each wash paddle 226 extends radially outward from central spray nozzle 222. Four wash paddles 226 are shown in FIG. 5, but more or less may be provided in some embodiments. Wash paddles 226 are depressible toward interior side 174. Wash paddles 226 are configured to activate the central spray nozzle 222 upon being depressed toward main door 116 so as to provide one or more sprays of fluid as previously mentioned.

The plurality of movable wash paddles 226 are sized to accommodate articles for cleaning of various sizes. In some embodiments, wash paddles 226 are sized such that a user may depress rim 262 or another part of article 260 (such as a cup, mug, bowl, or other) against wash paddles 226 to activate central spray nozzle 222 and spray an inside surface of article 260. Central spray nozzle 222 and rotating spray arm 224 may be sized to have a combined radius smaller than that of a typical cup or bowl, allowing rim 262 to cover central spray nozzle 222 and rotating spray arm 224 and while depressing wash paddles 226 to activate central spray nozzle 222.

Wash paddles 226 may include, for example, a spring-loaded system or other elements that bias wash paddles 226 away from interior side 174. Accordingly, when wash paddles 226 are depressed by a user, springs or other biasing elements counteract the user so as to urge wash paddles 226 to their original, non-depressed state. A manual valve 232 (FIG. 6) is activated upon depression of wash paddles 226, directing fluid through central spray nozzle 222 and in a direction away from interior side 174.

Continuing with FIGS. 5,6, and 7, quick-wash spray assembly 172 further includes a rotating spray disc or arm 224 as previously referenced. Rotating spray arm 224 is located radially outward of central spray nozzle 222 and surrounds nozzle 222. Spray arm 224 is rotatably supported on interior side 174. Central spray nozzle 222 is located in an axial center C of quick-wash spray assembly 172 with rotating spray arm 224 configured to rotate about central spray nozzle 222 and axial center C. Rotating spray arm 224 may rotate in one, or both directions of clockwise and counterclockwise. Rotating spray arm 224 is configured to provide fluid for cleaning one or more articles. Fluid sprayed from rotating spray arm 224 is directed toward interior surface 188 of secondary door 200 and will impinge upon articles placed on secondary door 200 when in the closed position. For this embodiment, rotating spray arm 224 includes a set of discharge ports 228 arranged on an outer surface 229 of rotating spray arm 224. The flow of fluid through discharge ports 228 causes rotation of spray arm 224.

With reference to FIGS. 6 and 7, quick-wash feature 132 includes a fluid supply assembly 133 in fluid communication with quick-wash spray assembly 172. A particular embodiment and operation of fluid supply assembly 133 will now be described. However, using the teaching disclosed herein, one of ordinary skill in the art will understand that other constructions and methods of operation may be used in still other embodiments of the invention.

For this embodiment, a conduit 238 connected with main door 116 provides a flow F of fluid to fluid supply assembly 133. Such fluid may be e.g., hot, warm, or cold water. Flow F of fluid travels to a tee 246 that is in turn connected with 1) a central nozzle supply conduit 240 that supplies fluid to central spray nozzle 222 and 2) a spray arm conduit 242 supplying fluid to rotating spray arm 224. As previously described, valve 232 allows for selective, manual control of the flow of fluid from conduit 240 by the depression (flow on) or release (flow off) of wash paddles 226.

Fluid supply assembly 133 also includes a control valve 230 that selectively controls the flow of fluid from conduit 242 to rotating spray arm 224. For this exemplary embodiment, main door 116 includes a user input panel 196 in communication with controller 160. Panel 196 allows a user to select between buttons or inputs for a quick-wash function 198 and a quick-rinse function 199.

In one exemplary aspect, the user places one or more articles on secondary door 200 for cleaning as previously described using e.g., article clamp 256 and then closes secondary door 200. The user may then select quick-rinse function 199 causing controller 160 to open control valve 230 to dispense rinse fluid through rotating spray arm 224. Valve 230 may remain open for a predetermined period of time, or valve 230 may remain open only while the user continues to press quick-rinse function 199. Combinations thereof may also be provided depending upon the programming of controller 160.

Alternatively, the user may select quick-wash function 198 causing controller 160 to open both control valve 230 and detergent valve 250 to dispense a mixture of wash fluid and liquid detergent through rotating spray arm 224. Valves 230 and 250 may remain open for a predetermined period of time or valve may remain open only while the user continues to press quick-wash function 198. Combinations thereof may also be provided depending upon the programming of controller 160. After washing, the user may then select quick-rinse function 199 to rinse the article(s) on secondary door 200 in quick-wash compartment 170 as previously described. Main door 116 may be open or closed during the operation of quick-wash function 198 and/or quick rinse function 199.

In still other embodiments of the invention, other fluid supply assemblies may be configured to supply other arrangements of nozzles and/or spray arms to quick-wash feature 132. For example, both central spray nozzle 222 and rotating spray arm 224 might be activated during a quick-wash or quick rinse.

The present invention is not limited to the particular size, shape, or location of quick-wash compartment 170 or secondary door 200. Using the teaching disclosed herein, one of ordinary skill in the art will understand that other configurations may be used as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber, the wash chamber having an opening;

a main door positioned at the opening to the wash chamber, the main door selectively movable between a closed position that covers the opening and an open position that allows access to the wash chamber through the opening;

at least one rack assembly slidably positioned within the wash chamber and configured for receipt of articles for washing;

at least one spray assembly positioned in the wash chamber near the at least one rack assembly and configured to direct wash fluids at the at least one rack assembly; and a quick-wash feature positioned on the main door, the quick-wash feature comprising a secondary door attached to the main door, the secondary door movable between an open position and a closed position, the main door and the secondary door forming a quick-wash compartment when the secondary door is in the closed position; and a quick-wash spray assembly providing fluid for cleaning, the quick-wash spray assembly located in the quick-wash compartment when the secondary door is in the closed position.

2. The dishwasher appliance of claim 1, wherein the quick-wash spray assembly further comprises a central spray nozzle configured to provide fluid for cleaning one or more articles.

3. The dishwasher appliance of claim 2, wherein the quick-wash spray assembly further comprises a rotating spray arm configured to rotate about the central spray nozzle and provide fluid for cleaning one or more articles.

4. The dishwasher appliance of claim 3, wherein the quick-wash spray assembly further comprising a plurality of wash paddles positioned around the rotating spray arm and the central spray nozzle, each wash paddle extending radially outward from the central spray nozzle, the plurality of wash paddles configured to activate the central spray nozzle upon being depressed towards the main door so as provide one or more sprays of fluid.

5. The dishwasher appliance of claim 4, wherein the quick-wash feature further comprises a control valve for connection with a fluid supply, the control valve configured to selectively allow for a flow of fluid to at least one of the central spray nozzle, and the rotating spray arm.

6. The dishwasher appliance of claim 1, wherein the secondary door further comprises one or more drain holes to drain wash fluid from the quick-wash compartment.

7. The dishwasher appliance of claim 1, wherein the quick-wash feature further comprises an adjustable article support assembly positioned on the secondary door.

8. The dishwasher appliance of claim 7, wherein the adjustable article support assembly comprises an article clamp slidable along the secondary door.

9. The dishwasher appliance of claim 8, wherein the article clamp comprises a silverware holder with a plurality of apertures configured to accept articles for washing or rinsing.

10. The dishwasher appliance of claim 1, further comprising a controller and a user input panel, the user input panel located on main door, the user input panel including one or more inputs whereby a user can selectively activate the quick-wash spray assembly.

11. The dishwasher appliance of claim 10, wherein the user input panel includes a quick-wash function that activates the quick-wash spray assembly for a predetermined period of time.

12. The dishwasher appliance of claim 1, further comprising a detergent reservoir positioned in the main door in fluid communication with the quick-wash feature.

13. A dishwasher appliance, comprising:

a tub defining a wash chamber, the wash chamber having an opening;

a main door positioned at the opening to the wash chamber, the main door selectively movable between a closed position that covers the opening and an open position that allows access to the wash chamber through the opening, the main door having an interior side facing the wash chamber when the main door is in the closed position;

at least one rack assembly slidably positioned within the wash chamber and configured for receipt of articles for washing;

at least one spray assembly positioned in the wash chamber near the at least one rack assembly and configured to direct wash fluids at the at least one rack assembly; and a quick-wash feature positioned on the interior side of the main door, the quick-wash feature comprising a secondary door attached to the interior side of the main door, the secondary door movable between an open position and a closed position, a section of the interior side of the main door and the secondary door forming a quick-wash compartment when the secondary door is in the closed position; and a quick-wash spray assembly providing fluid for cleaning, the quick-wash spray assembly located in the quick-wash compartment when the secondary door is in the closed position.

14. The dishwasher appliance of claim 13, the quick-wash spray assembly comprising a central spray nozzle configured to provide fluid for cleaning one or more articles, and a spray arm configured to rotate about the central spray nozzle and provide fluid for cleaning one or more articles.

15. The dishwasher appliance of claim 14, wherein the quick-wash spray assembly further comprising at least one wash paddle positioned around the spray arm and the central spray nozzle, each wash paddle extending radially outward from the central spray nozzle, the at least one wash paddle configured to activate the central spray nozzle upon being depressed towards the main door so as provide one or more sprays of fluid.

16. The dishwasher appliance of claim 13, wherein the quick-wash feature further comprises one or more drain holes to drain wash fluid from the quick-wash compartment.

17. The dishwasher appliance of claim 13, further comprising a controller and a user input panel, the user input panel located on main door, the user input panel including one or more inputs whereby a user can selectively activate the quick-wash spray assembly.

18. The dishwasher appliance of claim 13, wherein the quick-wash feature further comprises an adjustable article support assembly positioned on the secondary door, the adjustable article support assembly comprising a slidable article clamp, and the slidable article clamp comprising a silverware holder.

* * * * *